United States Patent [19]

Schluter

[11] Patent Number: 4,858,404

[45] Date of Patent: Aug. 22, 1989

[54] CLEAT FOR FINISHING OFF THE CERAMIC TILES ON A STEP

[76] Inventor: Werner Schluter, AM Schierloh 6, 5860 Iserlohn, Fed. Rep. of Germany

[21] Appl. No.: 323,204

[22] Filed: Mar. 13, 1989

Related U.S. Application Data

[63] Continuation of Ser. No. 141,049, Jan. 5, 1988, abandoned.

[30] Foreign Application Priority Data

Jan. 20, 1987 [DE] Fed. Rep. of Germany ..... 3701415

[51] Int. Cl.[4] ..... E04F 19/02; E04F 13/08

[52] U.S. Cl. ..... 52/179

[58] Field of Search ..... 52/179, 182

[56] References Cited

U.S. PATENT DOCUMENTS

| | | | |
|---|---|---|---|
| 1,503,773 | 8/1924 | Stanwood | 52/179 |
| 4,455,797 | 6/1984 | Naka | 52/179 |
| 4,486,987 | 12/1984 | Naka | 52/179 |

FOREIGN PATENT DOCUMENTS

| | | | |
|---|---|---|---|
| 2122623 | 11/1972 | Fed. Rep. of Germany | 52/179 |

*Primary Examiner*—John E. Murtagh

*Attorney, Agent, or Firm*—Collard, Roe & Galgano

[57] ABSTRACT

There is disclosed a cleat having a Z-shaped cross section for finishing off the ceramic tiles on a step or the like, the cleat having a thin fastening leg provided with breakthroughs and adapted to underlie the ceramic tile on the step, perpendicular thereto a closing off-leg extending in front of the tile on the step and perpendicular to the latter a step-on leg at the edge of the step. The step-on leg has molded onto its top side a soft elastic cover strip which covers the cleat which, as a whole, is manufactured in a single piece from plastic material and which has a lip downwardly projecting beyond the step-on leg which acts with prestress against the cleat. A colored insert strip is embedded in the cover strip in the center in the lengthwise direction and covered by a transparent plastic strip.

4 Claims, 2 Drawing Sheets

CLEAT FOR FINISHING OFF THE CERAMIC TILES ON A STEP

Figure 1:
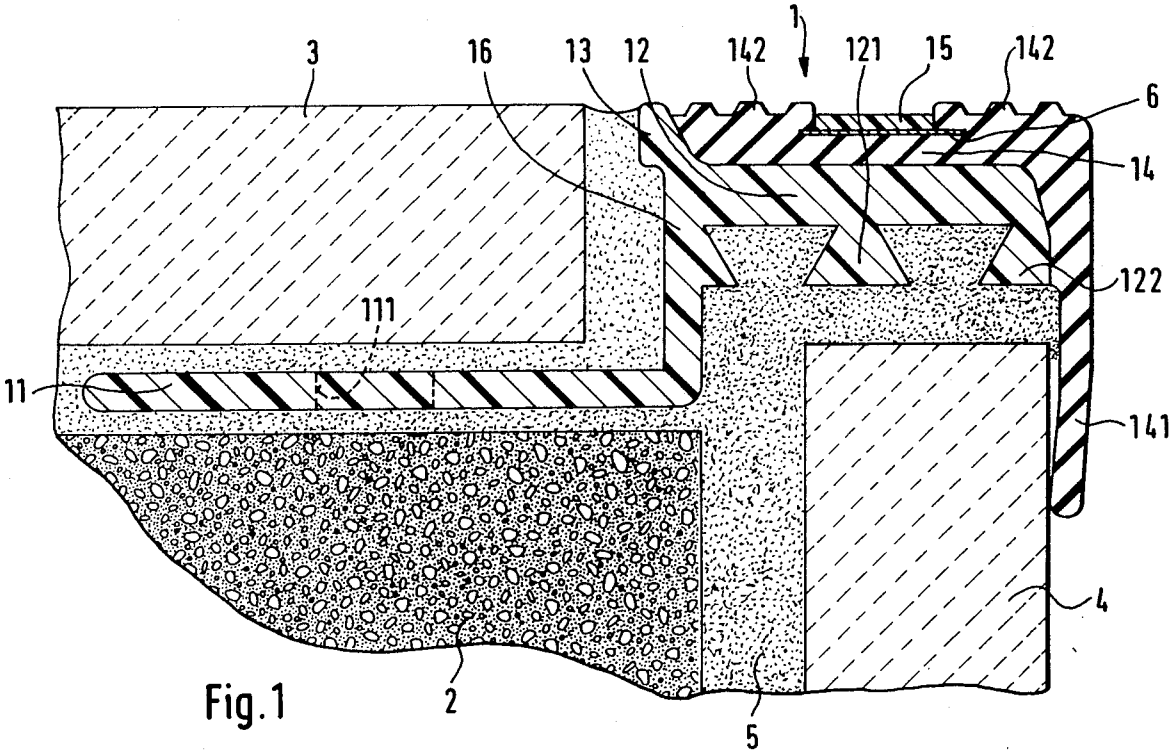

The present invention relates to a cleat or stair tread insert having a Z-shaped cross section for the finishing of ceramic tiles on a step or the like, such cleat having a thick fastening leg provided with breakthroughs, a finishing leg perpendicular thereto, and a step-on leg perpendicular to the latter, with at least one slip inhibiting cover strip made of plastic material provided on the top side of the step-on leg.

A cleat-like profile of the type described above is disclosed in German petty patent DE-GM 80 21 191. This known cleat prevents the increased risk of slipping on staircase steps with ceramic tile coverings. Because of the diminutive thickness of its fastening leg, this profile can be fastened under the ceramic tiles of a step without adding to the height of the structure. The step-on leg, according to this profile, has at least two fastening points for securing thereon a friction or slip inhibiting cover strip made of rubber or plastic material, which strip has to be snapped in place.

The object of the present invention is to enhance such tread inserts or cleats as safety elements on staircase steps and to facilitate and improve with such cleats the embodiment of the edge of the staircase step.

The above object of the present invention is accomplished with a strip of the type described above, wherein a soft, elastic cover strip is molded onto the top surface of the step-on leg of the cleat, which is made of plastic material in a single piece. The cover strip covers the cleat and has a lip downwardly projecting beyond the step-on leg and acting with prestress against the cleat.

A plastic profile according to the present invention can be manufactured in a single piece by means of known manufacturing techniques and devices so that an installation of the slip inhibiting cover strips as required with known metal profiles of the type specified above is dispensed with. Also, in this way, the risk of separation of these cover strips serving as safety element is prevented.

According to a preferred embodiment of the present invention, a colored insert strip is embedded in the cover strip in about the center of the lengthwise direction and covered by a transparent plastic strip. Such a colored insert strip creates an additional, visually attractive safety element, which attracts increased attention, for example, by a two color design in combination with the adjoining profile bridges.

Of special significance is the lip molded onto the outer profile bridge, which lip forms a cover of the joint at the nose of a staircase step within the zone of transition of the vertically disposed ceramic tiles.

Other objects and features of the present invention will become apparent from the following detailed description considered in connection with the accompanying drawings. It is to be understood, however, that the drawings are designed as an illustration only and not as a definition of the limits of the invention.

Figure 2:
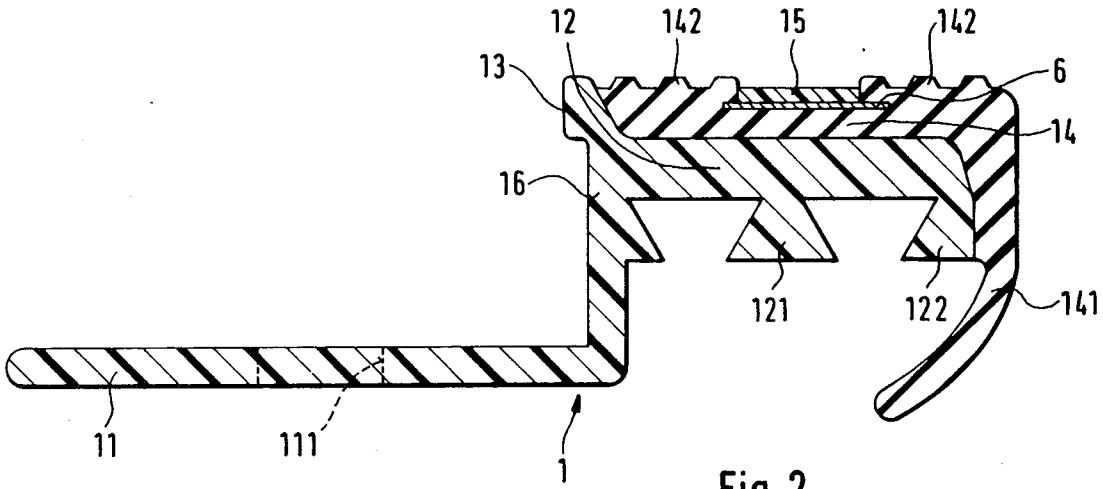

In the drawings, wherein similar reference characters denote similar elements throughout the several views:

FIG. 1 is a cross-sectional view of the edge zone of a step covered with tiles, with a cleat according to the present invention inserted in such zone; and FIG. 2 is an enlarged cross-sectional view of the cleat of FIG. 1.

Now turning to the drawings, there is shown in FIGS. 1 and 2 an unfinished step 2 cast from concrete, with a profile cleat generally designated 1, made of plastic material and having a Z-shaped cross section thereon. The cleat is inserted in the edge zone of step 2. A ceramic tile 3 is applied to the cleat from the top and another ceramic tile 4 extending in the vertical direction adjoins the cleat. In the present embodiment of a step, cleat 1 and tiles 3 and 4 are installed by the so-called thin-bed technique, whereby a relatively thin contact layer 5 of plaster or suitable adhesive is applied for securing such elements on the step. The fastening leg 11 of cleat 1 is inserted in the top layer. The plaster or adhesive passes through the breakthroughs 111 and joins within this zone the bottom side of tile 3 with the substrate or underground.

Closing off-leg 16 is disposed perpendicular to fastening leg 11 of cleat 1, which is manufactured in one piece from plastic, and has about the same thickness. Step-on leg 12 is disposed perpendicular to closing off-leg 16 and parallel with fastening leg 11. The plastic material used in these three legs is hard.

A relatively soft elastic and slip inhibiting cover strip 14 is molded onto the top side of step-on leg 12, covering the latter. A widening bridge 13 is molded inwardly onto cover strip 141 and a lip 141 is molded outwardly onto cover strip 14. Lip 14 is downwardly projecting beyond step-on leg 12 and acts with prestress against cleat 1. On the top side of the cover strip 14, bridges 142 or deepenings form the slip inhibiting elements.

FIG. 1 shows that once ceramic tile 4 has been installed, lip 141 adjoins the outer side of the tile under pressure and covers the joint. Clamping bridges 121 and 122, which, in the present embodiment, have a dovetail cross section, are molded onto the bottom side of step-on leg 12 and form chambers.

In molded-on cover strip 14, a colored insert strip 6 is arranged embedded in about the center in the lengthwise direction and covered by a transparent plastic strip 15, which is molded onto this arrangement as well.

A bridge 13, which influences the latter information of the joint, is molded inwardly directed onto the outer end of closing off-leg 16.

While only a single embodiment of the present invention has been shown and described, it will be obvious that many changes and modifications may be made thereunto without departing from the spirit and scope of the invention.

What is claimed is:

1. A stair cleat formed in a single unit of plastic material and having a Z-shaped cross section for use in the nose of a stair wherein the stair riser and the stair tread are formed of ceramic tiles having relatively thin layers of adhesive adhering the tiles to the unfinished step and adhesive filling the gaps between the stair cleat and the stair riser and between the stair cleat and the stair tread, the stair cleat comprising:

a thin fastening leg having breakthroughs therein and adapted to underlie the ceramic tile of the stair tread;

a closing off leg perpendicular to said fastening leg extending in front of the stair tread tile;

a step-on leg perpendicular to said closing off leg extending at the nose of the step;

a slip inhibiting cover strip provided on the top side of said step-on leg and formed of a soft elastic plastic material molded onto said stair cleat and covering the same; and a lip formed together with said slip inhibiting cover strip projecting beyond said step-on leg to press against the ceramic tile of the stair riser and cover the adhesive gap between the stair riser and the stair cleat.

2. The cleat as defined in claim 1, further comprising a colored insert strip arranged embedded in about the center in said cover strip and covered by a transparent plastic strip.

3. The cleat as defined in claim 2, wherein said transparent plastic strip is molded onto said cover strip.

4. The cleat as defined in claim 1, which further comprises clamping bridges forming chambers between one another molded onto the botom side of said step-on leg.

* * * * *